United States Patent [19]

Calacurcio

[11] 3,951,407

[45] Apr. 20, 1976

[54] DEVICE FOR USE ON A GOLF SHOE

[76] Inventor: Frank C. Calacurcio, 216 Brendenwood Terrace, Rockford, Ill. 61108

[22] Filed: Apr. 14, 1975

[21] Appl. No.: 567,691

[52] U.S. Cl. ..... 273/32 C; 273/188 A; 36/2.5 A; 36/127; 36/134

[51] Int. Cl.[2] ..... A63B 57/00; A63B 69/36

[58] Field of Search ..... 273/32, 35, 187, 188; 36/2.5 A, 2.5 AH, 59 R, 62

[56] References Cited

UNITED STATES PATENTS

| | | | |
|---|---|---|---|
| 2,087,945 | 7/1937 | Butler | 36/62 |
| 2,482,930 | 9/1949 | Norwood | 273/32 C |

*Primary Examiner*—George J. Marlo
*Attorney, Agent, or Firm*—Wolfe, Hubbard, Leydig, Voit & Osann, Ltd.

[57] ABSTRACT

A device for positioning the shoe of a golfer with the outside edge of the shoe elevated with respect to the inside edge includes a crosspiece extending laterally across the instep of the shoe and a strap which is connected between the opposite ends of the crosspiece to hold the latter on the shoe. An arm is connected pivotally to the inner end portion of the crosspiece to swing between an out-of-the-way position within the instep for walking and a support position for elevating the outside edge of the shoe. In the support position, the outer end portion of the arm is spaced downwardly from the crosspiece to engage the ground and the arm is held in such position by a brace having one end hinged to the outer end portion of the arm and an opposite free end which abuts the crosspiece. To collapse the device for walking, the free end of the brace is swung from beneath the crosspiece to enable the arm to be swung into its out-of-the-way position.

10 Claims, 5 Drawing Figures

DEVICE FOR USE ON A GOLF SHOE

BACKGROUND OF THE INVENTION

This invention relates generally to a device particularly adapted to aid in positioning a golfer's stance for swinging at a golf ball. More particularly, the invention relates to a device such as may be attached to the golfer's trailing shoe to hold the outside edge of the shoe in an elevated position with respect to the inside edge so as to aid in positioning of the golfer's body to assume a proper stance and follow-through when swinging at a golf ball. One such device is disclosed in U.S. Pat. No. 3,195,891.

SUMMARY OF THE INVENTION

The primary object of the present invention is to provide a new and improved device of the above general character which may be used in regular play without having to be removed from the golfer's shoe in order to walk in a normal fashion. A more detailed object is to achieve the foregoing through the provision of a device which, when used during swinging, supports the outside edge of the shoe in the desired elevated position but is collapsible to fit within the instep area of the sole of the shoe so as to avoid interfering with the golfer when walking.

The invention also resides in the unique construction of the device with parts limited to pivot with respect to each other generally between one position for supporting the outside of the shoe in its elevated position and another position for normal walking with the device attached to the shoe.

Still further, the invention resides in the novel fashion in which parts of the device are kept from flopping on the shoe when walking and in which the shoe is supported against sliding on the device in service use.

These and other objects and advantages of the present invention will become more apparent from the following detailed description when taken in conjunction with the accompanying drawings.

DETAILED DESCRIPTION OF THE PREFERRED EMBODIMENT

Figure 1:
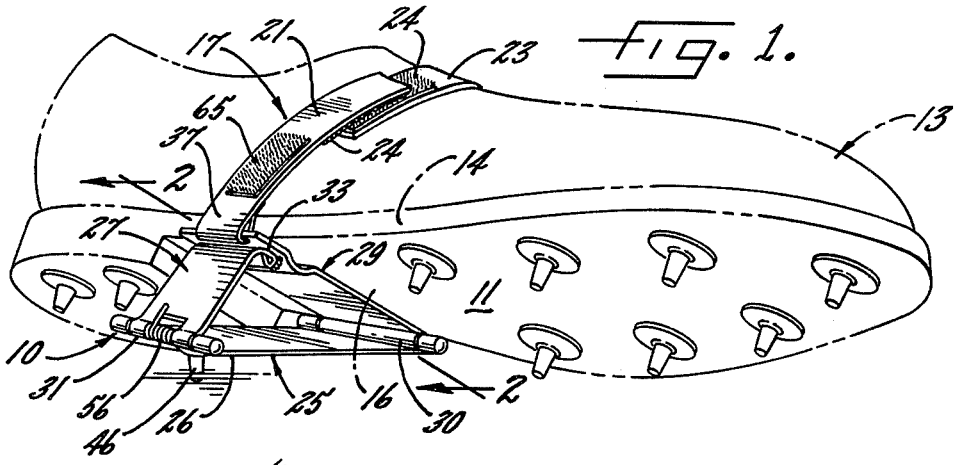
FIG. 1 is a perspective view of a device embodying the novel features of the present invention as attached to a golf shoe.

As shown in the drawings for purposes of illustration, the present invention is embodied in a device 10 adapted for attachment to the underside or sole 11 of a golf shoe 13 to support the outside edge 14 of the shoe in an elevated position with respect to the inside edge 15 thereof in order to help properly position a golfer's body for swinging. In use, the device is placed within the instep 16 of the shoe on the trailing foot of the golfer when in position to swing and is secured to the shoe by way of a strap 17 extending across the top of the shoe between the opposite ends of the device.

Herein, the strap is adjustable in length including overlapping portions 21 and 23 detachably secured together by means of fastening strips 24 of the type having interlocking complimentary fibers such as the material sold under the trademark VELCRO. It will be appreciated, however, that other types of fasteners such as a conventional buckle could be used to fasten the overlapping portions of the strap together.

In accordance with the primary aspect of the present invention, the device 10 is constructed in a novel fashion to collapse within the instep 16 of the shoe 13 when not in use so as to avoid interfering with the golfer when walking. For this purpose, the device includes an arm 25 attached to the shoe and having one end portion 26 movable away from and toward the underside 11 of the shoe. In the away or support position, the one end portion of the arm is spaced from the underside of the outside edge 14 of the shoe with a brace 27 acting between the arm and the shoe to hold the arm in such position. Thus, the end portion of the arm is positioned for engagement with the ground to support the outside edge above the inside edge 15 of the shoe. In this way, the golfer is aided in maintaining a proper body position when swinging at a golf ball. To collapse the device, the brace is released from between the shoe and the arm to permit the latter to be swung into the instep and out of the way for normal walking even though the device remains attached to the shoe.

Figure 2:
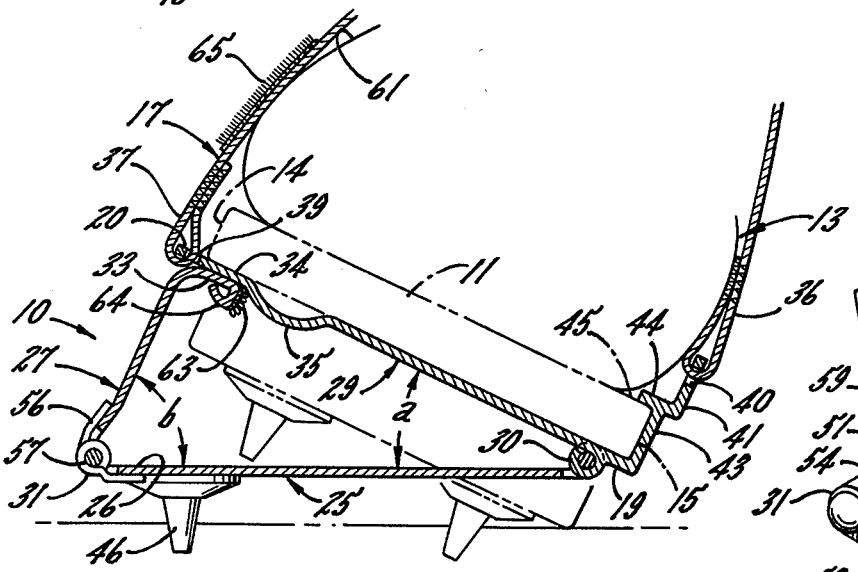
FIG. 2 is an enlarged cross-sectional view taken substantially along line 2—2 of FIG. 1.
Figure 3:
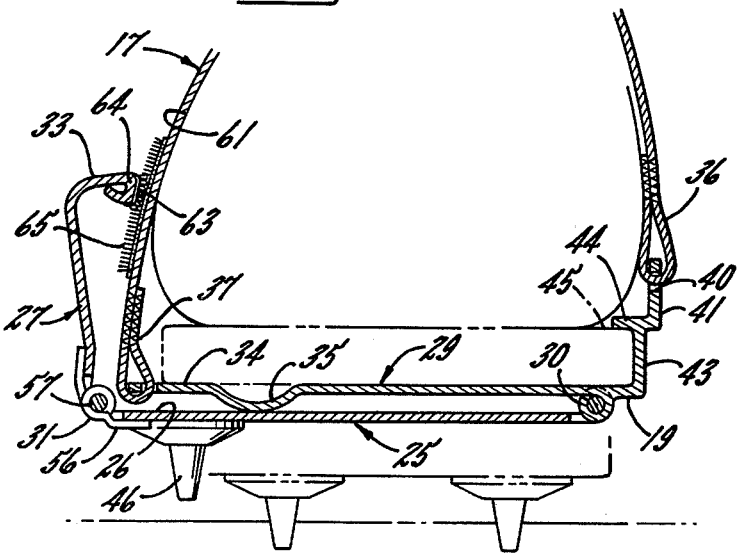
FIG. 3 is a view similar to FIG. 2 but showing parts of the device in moved positions.
Figure 5:
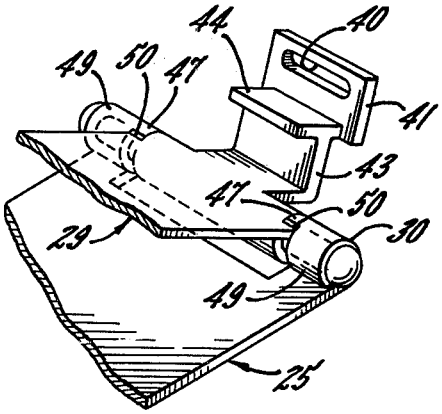
FIG. 5 is an enlarged, fragmentary perspective view of the other end of the device.

In the present instance, the device 10 includes a generally rectangular crosspiece 29 adapted to fit within the instep 16 of the shoe 13 so as to extend laterally across the sole 11 from the inside edge 15 thereof to the outside edge 14. The arm 25 is connected pivotally with the crosspiece by way of an inside hinge 30 (see FIGS. 2 and 5) located at the inner end 19 of the crosspiece. An outside hinge 31 pivotally connects the brace 27 to the one or outer end 26 of the arm and is in the form of an inverted, generally L-shaped piece whose upper end portion 33 extends in a generally inward direction relative to the outside edge of the sole. To support the outside edge of the sole of the shoe in an elevated position with respect to the inside edge, the upper end portion of the brace abuts the underside of an outer end portion 34 of the crosspiece as is shown in FIG. 2. A boss 35 in the form of a rib projecting downwardly from the underside of the crosspiece serves to keep the outer end portion of the brace from sliding inwardly relative to the crosspiece. When the device is collapsed for walking, the rib engages with the arm (see FIG. 3) to keep the arm parallel with the crosspiece and to provide support for the outer end portion of the arm. In this way, the center portion of the arm is better supported against being bent upwardly against the crosspiece when walking.

To hold the device 10 on the shoe 13, the inner and outer ends 36 and 37 of the strap 17 are connected to the inner and outer end portions 19 and 20 of the crosspiece 29, respectively. Herein, the outer end of the strap is fastened to the crosspiece within an elongated slot 39 formed through the outer end portion of the crosspiece. The inner end of the strap is fastened to the crosspiece within a similar slot 40 which extends through a tongue 41 projecting upwardly from a shoulder 43 (see FIG. 2) formed on the inner end of the crosspiece. Advantageously, the shoulder extends upwardly from the crosspiece along the inside edge 15 of the sole and includes a flange 44 which is spaced upwardly from the crosspiece and extends toward the inside of the shoe for engagement with the upper margin 45 of the sole. With the device expanded as shown in FIG. 2, the shoulder and flange keep the shoe from sliding on the crosspiece so as to assure proper positioning of the golfer's foot when swinging. Further, to help keep the golfer's foot from sliding on the ground when swinging, a spike 46 is attached to the outer end portion 26 of the arm and extends downwardly therefrom to embed in the ground.

As an aid in positioning the arm 25 and the brace 27 to support the shoe 13 for swinging, both the inner and outer hinges 30 and 31 are stop hinges, limiting the extent of angular movement of the arm and brace. For instance, the inner hinge (see FIG. 5) includes circumferential fingers 47 extending in a generally axial direction from the hinge curls 49 in the arm to abut stop shoulders 50 on the crosspiece 29. By virtue of this construction, the arm is limited to swing away from the crosspiece to form an acute included angle therebetween which is substantially equal to an acute angle *a* (see FIG. 2) formed between the crosspiece and the arm when the device is in its expanded condition. In addition, the outer stop hinge limits the extent to which the brace may swing inwardly beneath the crosspiece so as to form an acute included angle with respect to the arm, such angle being approximately equal to the angle *b* between the arm and the brace when the device is in its expanded condition.

Figure 4:
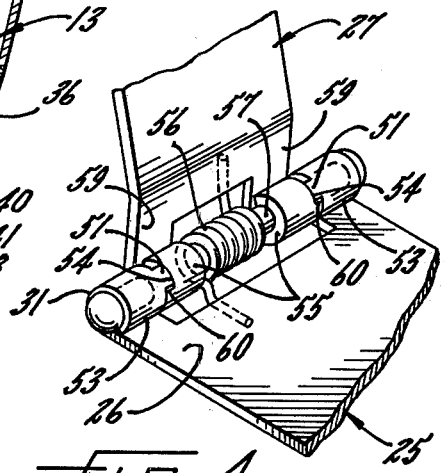
FIG. 4 is an enlarged, fragmentary perspective view of one end of the device.

As shown in FIG. 4, the outer hinge 31 includes fingers 51 projecting toward each other in a generally axial direction from the hinge curls 53 formed in the arm 25. More particularly, the fingers extend into recesses 54 formed in the hinge curls 55 of the brace 27, and the brace is urged inwardly by a spring 56 coiled around the pin 57 of the outer hinge so that the outward sides of the fingers abut the opposite side margins 59 of the brace when the brace is swung into its inward position. Advantageously, the brace also is limited in swinging in an outward direction by the inner sides of the fingers as they abut the inner ends 60 of the recesses 54. It will be appreciated that through the use of the stop hinges 30 and 31 and the spring 56, the device 10 may be expanded easily to support the golfer's foot for swinging by moving the arm and the brace into their support positions by simply pulling outwardly and downwardly on the brace until the upper end 33 thereof is beneath the crosspiece 29 at which point the brace may be released to swing inwardly under the urging of the spring.

To hold the device in its collapsed condition for walking, the brace 27 extends upwardly along the outside 61 of the shoe and is held releasably in this position by suitable fastening means. Herein, this is accomplished with strips of the VELCRO material previously mentioned. A small strip 63 of the material is fastened to the free end 64 of the brace to catch with a larger strip 65 secured to the outer end portion 37 of the strap 17. Thus, the brace is held against the outside of the shoe to hold the arm out of the way within the instep of the shoe so that the device is kept from flying apart or flopping on the shoe when the golfer is walking.

As is seen from the foregoing, the golf shoe support device 10 of the present invention is particularly adapted to aid a golfer in positioning his body for swinging by elevating the outside edge 14 of the shoe 13 with respect to the inside edge 15 but is collapsible so as to enable the golfer to walk in a normal fashion when not needed. Advantageously, this is achieved by constructing the device to include the pivotal arm 25 and the brace 27 which are movable with respect to each other so as to permit the device to be collapsed for walking.

I claim as my invention:

1. A device adapted for use on a golf shoe to support one edge of the shoe in an elevated position with respect to the opposite edge thereof so as to aid in positioning a golfer for swinging, said device including an arm connectable with the shoe on the underside thereof and having one end portion movable away from and toward the underside of the shoe between a first position spaced downwardly from the one edge of the shoe for engagement with the ground to support the one edge in its elevated position and a second out-of-the-way position closely adjacent the underside of the shoe, and a brace for acting between said arm and said shoe to support said end portion in said first position, said brace being movable to release said end portion for movement into its out-of-the-way position to enable the golfer to walk in a normal manner while said device remains on the shoe.

2. A device adapted for use on a golf shoe to support the outside edge of the shoe in an elevated position with respect to the inside edge thereof to aid in positioning a golfer for swinging, said device including a crosspiece mountable within the instep of the shoe in engagement with the sole of the shoe and extending laterally across the sole between the inside and outside edges, a strap having opposite ends connected to the inner and outer ends of the crosspiece so as to extend across the top of the shoe for securing the crosspiece on the shoe, an arm having an inner end portion pivotally connected to the inner end portion of said crosspiece to swing between a support position with the outer end portion of the arm spaced downwardly from the outer end of the crosspiece and an out-of-the-way position with the arm extending generally parallel with the crosspiece to avoid interfering with the golfer when walking, and a brace with one end pivotally connected to the outer end portion of said arm and an opposite free end, said brace being movable between a first position with said free end abutting said crosspiece to hold said arm in said support position and a second position with said free end out of abutting engagement with said crosspiece to permit said arm to be swung into its out-of-the-way position.

3. A collapsible device as defined by claim 2 including a shoulder connected to the inner end of said crosspiece and extending upwardly therefrom for abutting engagement with the inside edge of the sole of the shoe to keep the shoe from sliding on said crosspiece.

4. A collapsible device as defined by claim 3 including a flange projecting outwardly from the upper end of said shoulder to hook across the upper margin of the inside edge of the sole to aid in holding said crosspiece on the shoe.

5. A collapsible device as defined by claim 3 including a boss formed on the underside of said crosspiece intermediate the inner and outer ends thereof and extending downwardly therefrom for abutment with said free end of said brace to support the latter in its first position.

6. A collapsible device as defined by claim 5 including a spring acting between said brace and said arm and urging said brace to swing into its first position to abut said boss.

7. A collapsible device as defined by claim 6 including a first stop hinge pivotally connecting the inner end of said arm to the inner end of said crosspiece and limiting the extent to which said arm may be swung away from said crosspiece.

8. A collapsible device as defined by claim 7 including a second stop hinge pivotally connecting the lower end of said brace to the outer end of said arm and limiting the arcuate distance between said first and second positions of said brace.

9. A collapsible device as defined by claim 8 including a spike fastened to the underside of said arm adjacent the outer end thereof and extending downwardly therefrom to embed in the ground.

10. A collapsible device as defined by claim 9 wherein said brace extends upwardly along the outside of said shoe when in said second position, fastening means connectable between said free end of said brace and said strap to hold said brace releasably in said second position.

* * * * *